US007466084B2

(12) United States Patent
Juen

(10) Patent No.: US 7,466,084 B2
(45) Date of Patent: Dec. 16, 2008

(54) DIGITAL INTERFACE WITH POTENTIOMETER

(75) Inventor: Reinhold Juen, Dornbirn (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 17 days.

(21) Appl. No.: 10/879,110

(22) Filed: Jun. 30, 2004

(65) Prior Publication Data

US 2005/0023989 A1 Feb. 3, 2005

(30) Foreign Application Priority Data

Jul. 1, 2003 (DE) ..... 103 29 683

(51) Int. Cl.
*H05B 37/02* (2006.01)

(52) U.S. Cl. ..... 315/224; 315/247; 315/291; 315/307

(58) Field of Classification Search ..... 315/224, 315/209 R, 247, 246, 291, 307
See application file for complete search history.

(56) References Cited

U.S. PATENT DOCUMENTS

| | | | | |
|---|---|---|---|---|
| 3,965,388 | A * | 6/1976 | Brisk | 315/155 |
| 5,277,497 | A * | 1/1994 | Enomoto | 377/114 |
| 5,539,281 | A | 7/1996 | Shackle et al. | 315/224 |
| 5,557,174 | A | 9/1996 | Johler | 315/194 |
| 5,614,811 | A | 3/1997 | Sagalovich et al. | 323/207 |
| 5,619,081 | A * | 4/1997 | Gershen et al. | 307/125 |
| 5,872,429 | A | 2/1999 | Xia et al. | 315/194 |
| 5,945,789 | A | 8/1999 | Chou | 315/293 |
| 6,057,651 | A * | 5/2000 | Usami | 315/291 |
| 6,094,016 | A | 7/2000 | Luger et al. | 315/295 |
| 6,218,787 | B1 | 4/2001 | Murcko et al. | 315/194 |
| 6,229,271 | B1 | 5/2001 | Liu | 315/291 |
| 6,445,089 | B1 * | 9/2002 | Okui | 307/66 |
| 6,448,713 | B1 * | 9/2002 | Farkas et al. | 315/291 |
| 6,870,326 | B1 * | 3/2005 | Stevens | 315/224 |

FOREIGN PATENT DOCUMENTS

| | | |
|---|---|---|
| CA | 2345456 | 10/2002 |
| DE | 19757295 A1 | 9/1998 |
| EP | 0641148 B1 | 3/1995 |
| EP | 1128711 A2 | 8/2001 |

* cited by examiner

*Primary Examiner*—Tuyet Vo
(74) *Attorney, Agent, or Firm*—Fitzpatrick, Cella, Harper & Scinto

(57) ABSTRACT

An interface for a lamp operating device, in particular a ballast (EVG) for gas discharge lamps, has two input side terminals of a digital control input SE and a evaluation logic (AL) which is constituted for processing both digital signals applied to the terminals and also mains voltage signals. The amplitude of a mains voltage applied to the terminals is continuously settable by means of a voltage divider (ST) or a potentiometer. The amplitude of the applied mains voltage is converted into pulse width information (PWM) which in turn the evaluation logic converts into control commands, for example dimming setting values, for a ballast (EVG).

8 Claims, 3 Drawing Sheets

DIGITAL INTERFACE WITH POTENTIOMETER

BACKGROUND OF THE INVENTION

1. Field of the Invention

The invention relates generally to an interface for a lamp operating device, in particular for a ballast for a gas discharge lamp, to lamp operating devices having such interfaces and to methods of generating control commands, in particular dimming commands for a lamp operating device.

A user should thus be provided with the possibility of entering manually, via a digital interface, control commands, in particular dimming commands for an electronic ballast.

2. Description of the Related Art

From EP 0 641 148 A1 it is generally known to carry out a dimming of an electronic ballast for supplying a load, such as for example a lamp, by means of an analogue phase control technique.

There is also known from German patent application 197 08 784 an electronic ballast which has (in the configuration according to FIG. 7) an interface device. This interface device can thereby be controlled via key signals or switch signals, as also via digital control signals. In the case of a connected key device, a connected electronic ballast can then be switched on or switched off by a (short or long) key press. In the same manner, however, a DSI (Digital Signal Interface) operation is also possible with which certain digital commands transmit for example desired values for brightness regulation etc.

With the interface device known from DE 197 08 784 it is disadvantageous that upon connection to an interface device of a key or switch supplied with mains voltage the user must select that duration of actuation of the key or switch which corresponds to the dimming value desired by the user. In other words, the user must mentally convert a dimming value into an actuation duration for the key or switch.

SUMMARY OF THE INVENTION

Starting from this state of the art it is object of the present invention to constitute more intuitively the manual input of control commands (for example dimming desired values) for electronic ballasts having a digital interface. Further it is object to the present invention to make available a simple possibility for dimming such an operating device by means of a digital interface.

In accordance with the invention, there is provided an interface for a lamp operating device, in particular for electronic ballast (EVG) for gas discharge lamps. Thereby, the interface has two terminals of a digital control input, on the input side, and evaluation logic which basically can process both digital signals applied to the terminals and also mains voltage signals. At the digital control input there is thereby provided a voltage divider or a potentiometer for the continuous setting of the amplitude of the mains voltage applied to the terminals of the digital control input. The setting of a potentiometer in the manner of a dimmer is more intuitive for the user since now a position (for example a rotary position), and no longer a temporal duration, represents the desired dimming value.

Further, the interface may have means for converting the amplitude of the applied mains voltage into pulse width information.

The evaluation logic can be constituted for converting the (digital) pulse width information into control commands for a lamp operating device. In particular the evaluation logic can be constituted to convert the pulse width information into dimming setting values for a lamp operating device.

Zener diodes may thereby subject the mains voltage applied at the digital interface to a bipolar thresholding.

In accordance with a further aspect of the present invention, there is provided a lamp operating device, in particular a dimmable ballast for gas discharge lamps, which has an interface of the kind indicated above.

Finally, the invention also proposes a method for the generation of dimming commands for a lamp operating device, in particular for a ballast for gas discharge lamps. Thereby, the amplitude of a mains voltage applied to a digital interface is detected and the amplitude height converted into digital pulse width information which reproduces for how long the amplitude of the mains voltage has exceeded or fallen below a predetermined threshold value. This pulse width information can then be digitally processed as dimming command for the lamp operating device.

The amplitude of the applied mains voltage may thereby be continuously settable.

The conversion of the amplitude height into digital pulse width information may be effected in particular by means of a Zener diode circuit.

BRIEF DESCRIPTION OF THE DRAWINGS

Further features, advantages and characteristics of the present invention will now be described in more detail with reference to the Figures of the accompanying drawings and to the following description of exemplary embodiments.

DETAILED DESCRIPTION OF THE PREFERRED EMBODIMENTS

Figure 1:
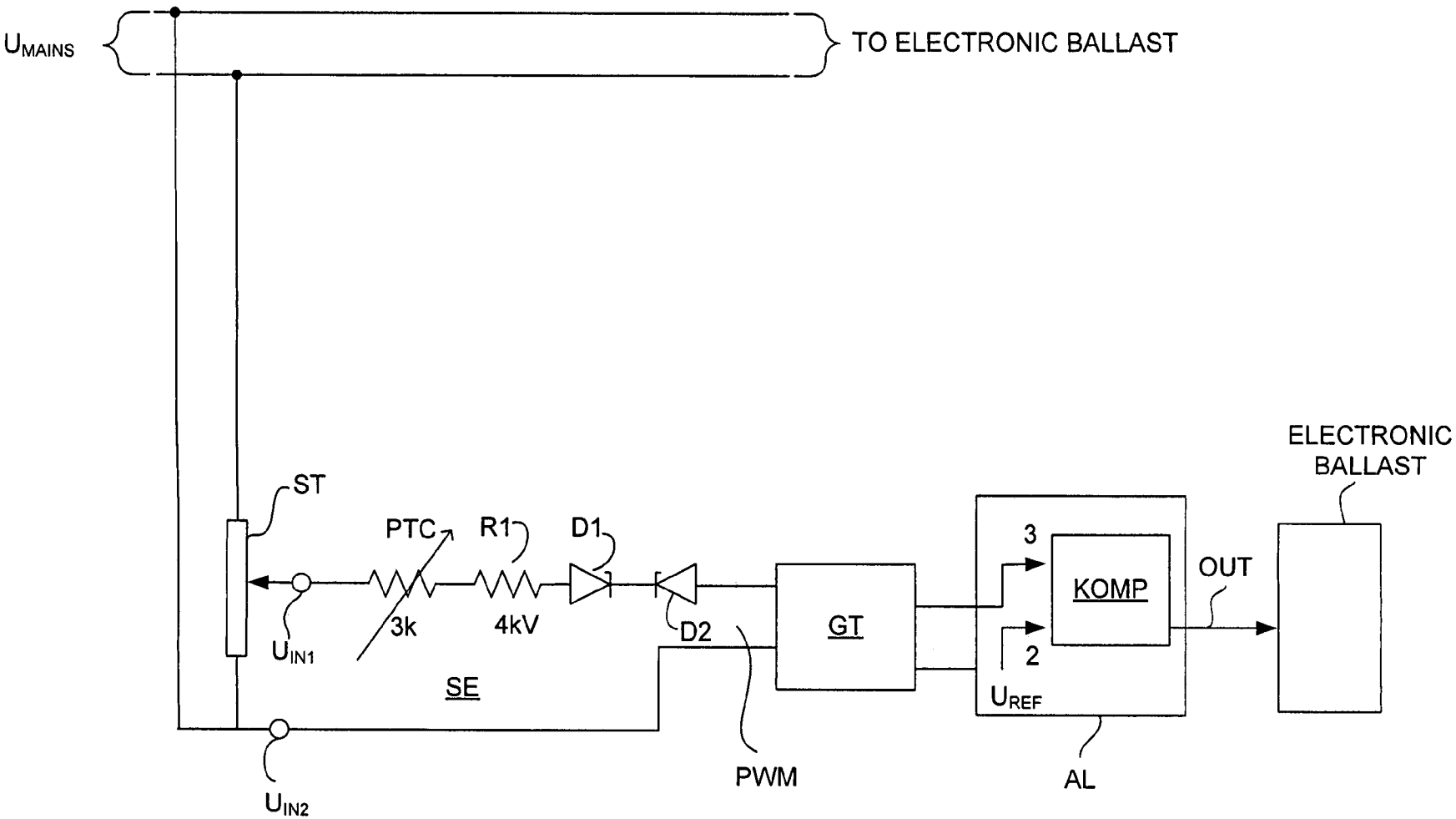
FIG. 1 is a block and circuit showing a detailed view of a first exemplary embodiment of the present invention.

As can be seen in FIG. 1, an interface device in accordance with the present invention has two input-side terminals $U_{IN1}$, $U_{IN2}$ of a digital control input SE. To these input-side terminals $U_{IN1}$, $U_{IN2}$ there can basically be applied digital signals for example with a maximum amplitude between 20 and 30 volts, and also mains voltage signals. Thereby the invention relates to the case that signals are applied to the digital control input SE from a mains voltage.

The interface device processes the signals applied to the input-side terminals $U_{IN1}$, $U_{IN2}$ in such a manner that independently of the nature of the applied signals there is issued at an output-side terminal OUT a digital signal the logical value of which corresponds to that of the signal applied to the input-side terminals $U_{IN1}$, $U_{IN2}$. The digital logic signal issued from the interface device may then for example be evaluated by a following controller, which in turn controls correspondingly a connected electronic device, such as for example a lamp operating device (e.g. electronic ballast EVG) or LED operating device.

The input side (terminals $U_{IN1}$, $U_{IN2}$) and the output side (OUT) of the interface device in accordance with the invention are galvanically separated from one another, which is schematically represented by means of the element GT. As element GT for galvanic separation (potential separation)

there may thereby be considered for example optocouplers, transformers and level offset stages.

One of the input-side terminals $U_{IN2}$ may be directly connected with this element for galvanic separation. On the other hand, between the other input-side terminal $U_{IN1}$ and this element GT there may be connected an ohmic resistance R1, an element having positive temperature coefficient PCT (PTC element) and two (optional) Zener diodes D1 and D2 in series.

The output signals of the element GT for galvanic separation are delivered to evaluation logic AL which has a comparator KOMP. The comparator KOMP compares the output signal of the element GT for galvanic separation (input 3 of the comparator) with a reference or threshold value signal of comparator KOMP applied to the inverting input 2. In dependence upon the comparison the comparator KOMP then passes on the logic signal OUT for example to the controller.

In the configuration of the interface device illustrated in FIG. 1 attention was particularly directed to there being employed relatively few and economic components. As explained below, such an interface device has however the necessary robustness with respect to a permanently applied mains voltage and with respect to voltage spikes (bursts).

Upon application of a mains voltage signal, the ohmic resistance R1 must transform electrical energy into heat for so long until the PTC element heats up and enters the highly resistant condition, through which the current through this path then falls again.

The Zener diodes D1 and D2 serve for defining the low level of the digital signal.

For the present invention it is basically sufficient that the interface is configured to process an analogue signal derived from a mains voltage signal at the digital control input.

As can be seen in FIG. 1, upstream of the digital control input SE there is a voltage divider (potentiometer) ST which is supplied with mains voltage $U_{NETZ}$. By means of this voltage divider ST it is possible to substantially continuously set the amplitude of the mains voltage $U_{NETZ}$ applied to the digital control input. Otherwise, also other means are conceivable in order to alter the amplitude of the delivered mains voltage.

Figure 2:
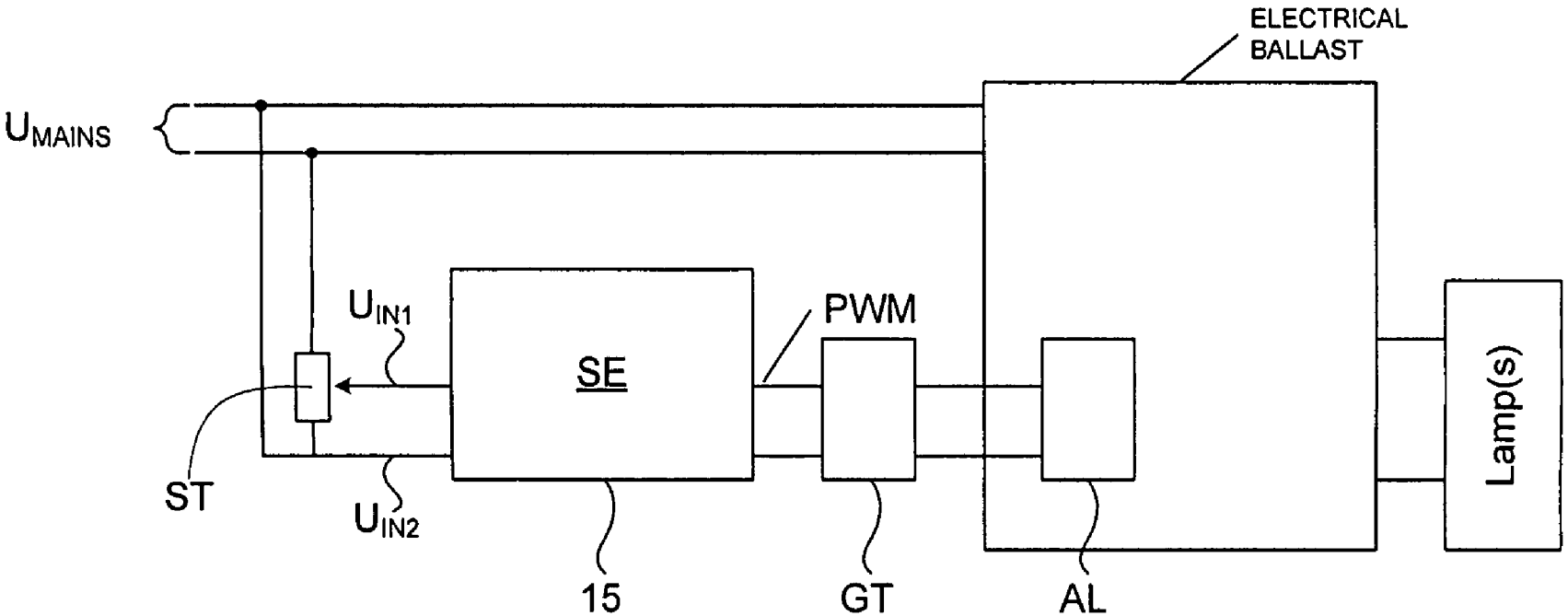
FIG. 2 is a block and circuit diagram showing a further exemplary embodiment of the present invention, in which the evaluation logic (AL) is integrated into a ballast (EVG) for lamps, and FIG. 3 comprises timing diagrams showing the voltage ($U_{SE}$) applied to the digital control input and the pulse width modulation (PWM) arising therefrom.

FIG. 2 shows a modification of FIG. 1 to the effect that the evaluation logic AL in accordance with FIG. 2 is part of the operating device EVG. Further it is also provided in accordance with FIG. 2 that a voltage divider ST, which is supplied with the mains voltage $U_{NETZ}$, is connected with a control input ST of the interface ES, i.e. more precisely to the two input side terminals $U_{IN1}$, $U_{IN2}$.

As will now be explained with reference to FIG. 3, a circuit in the interface ES (for example the Zener diode circuit D1, D2 in accordance with FIG. 1) provides that the (analog) amplitude information of the output of the voltage divider ST and thus at the input of the digital control input SE of the interface IS is converted into a (digital) pulse width modulation, which is delivered to the evaluation logic AL and in turn converted into control signals for a connected operating device EVG by this evaluation logic. In particular, the amplitude information which is set by the user by means of the potentionmeter ST can be converted into pulse width information and then converted by the evaluation logic into dimming setting values for a ballast. The setting of the amplitude may thereby be effected steplessly by means of the voltage divider/potentiometer ST.

Figure 3:
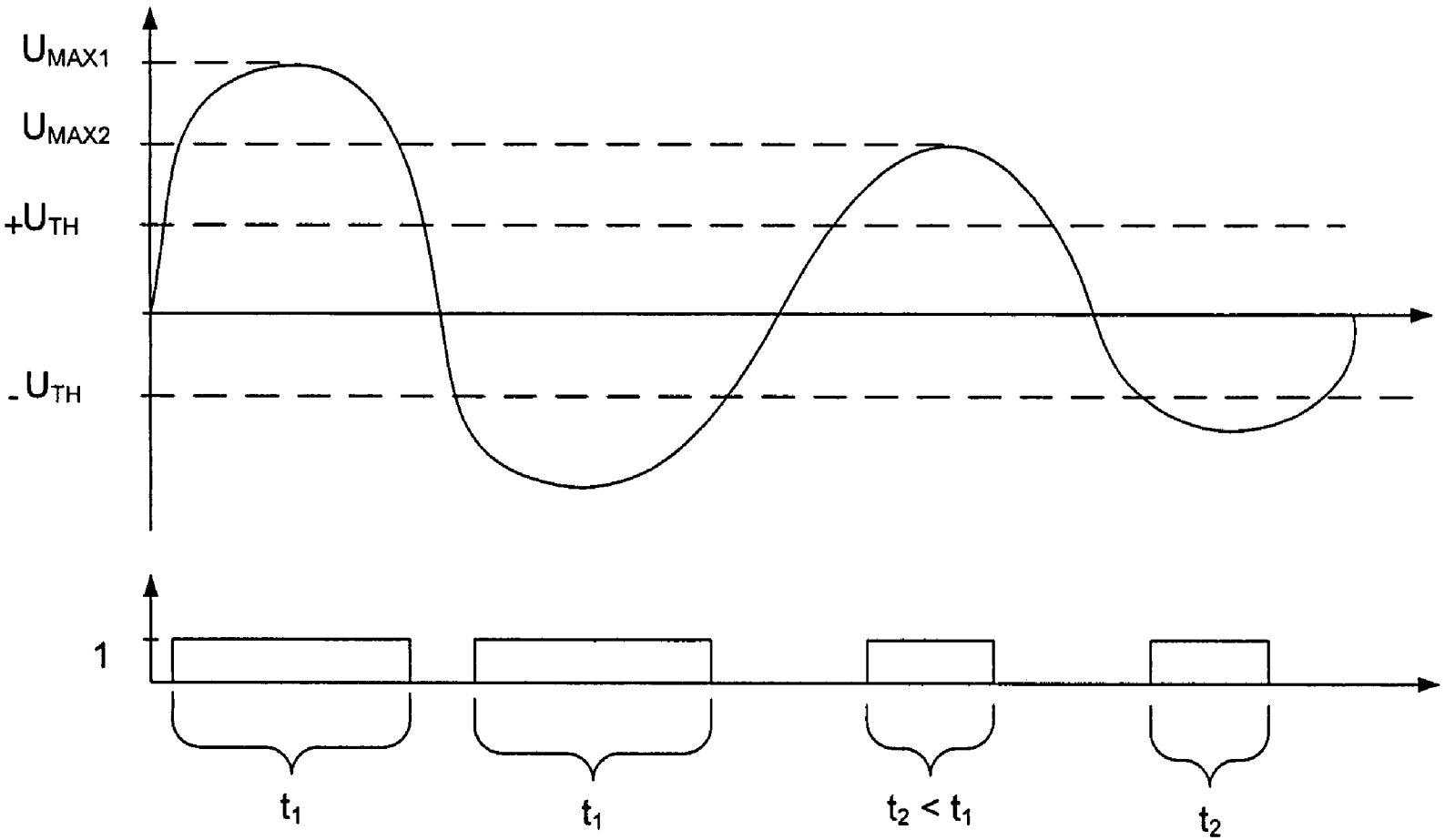

In FIG. 3 the case is illustrated that the peak value of the voltage applied to the digital control input SE at one time has a value $U_{MAX1}$ and at another time point has a smaller value ($U_{MAX2}<U_{MAX1}$). The peak value at the digital control input SE can for example be set by a user by hand and a potentionmeter. In the interface circuit ES there is carried out, for example by means of the Zener diode circuit D1, D2 illustrated in FIG. 1, a thresholding $+-U_{TH}$. The input signal of the evaluation logic AL correspondingly appears schematically as in FIG. 3, lower representation. In the case of a high amplitude $U_{MAX1}$ the a.c. voltage apply to the digital control input SE provides a PWM signal with relatively higher switch-on duration $t_1$ and correspondingly a large duty ratio.

If, in contrast, by the means of the potentiometer/voltage divider ST the amplitude of the a.c. voltage applied to the digital control input SE of the interface ES is damped to a value $U_{MAX2}<U_{MAX1}$, there is provided at the input of the evaluation logic AL, as illustrated in FIG. 3, lower representation, a PWM signal with a reduced switch-on duration $t_2<t_1$, and correspondingly reduced duty ratio.

The duty ratio is then converted into dimming setting values, on/off commands etc. by the evaluation logic AL on the basis of a table or function implemented in it.

By means of the invention there can thus be realised a dimmable ballast having an interface which can be dimmed both with digital control signals (e.g. DALI, DSI) and also with a continuously settable mains voltage. The mains voltage $U_{NETZ}$ is thereby delivered via a voltage divider ST to the digital control input SE of the interface SI.

Depending upon the setting of the potentiometer ST the voltage at the digital control input SE also changes. The interface circuit SE delivers this variable voltage or an equivalent signal to the evaluation logic AL via a galvanic coupling GK. The evaluation logic AL then ensures that for example a lamp is dimmed correspondingly to the signal amplitude applied to the digital control input SE.

The invention can be put to use for example in simple manner with dimmable standard lamps which in many cases are already equipped with a potentiometer/dimmer.

The invention claimed is:

1. An interface circuit for a lamp operating device such as an electronic ballast for gas discharge lamps, said circuit including:

a digital control input and evaluation logic portion connected to digital signals fed to terminals of the interface and to issue control commands, the digital control input comprising resistance circuitry withstanding for an applied voltage, regardless of whether the applied voltage is a permanently-applied AC mains voltage or digital control signals; and a settable voltage divider connected with the digital control input and arranged to be supplied with an AC voltage, for setting an amplitude of the AC voltage applied to the digital control input.

2. An interface circuit according to claim 1, further comprising Zener diodes arranged to subject the applied AC voltage to bipolar thresholding.

3. A lamp operating device, in particular a dimmable ballast for gas discharge lamps, having an interface circuitry in accordance with claim 1.

4. An interface circuit according to claim 1, further comprising means for converting the amplitude of the applied AC voltage into pulse width information.

5. An interface circuit according to claim 4, wherein the evaluation logic is constituted to convert the pulse width information into control commands for a lamp operating device.

6. An interface circuit according to claim 4, wherein the evaluation logic is constituted to convert the pulse width information into dimming setting values for a lamp operating device.

7. An interface circuit for a lamp operating device, such as an electronic ballast for gas discharge lamps, said interface circuit including:

a digital control input and evaluation logic for processing digital signals fed to terminals of the interface circuit and for issuing control commands, the digital control input comprising resistance circuitry withstanding for an applied voltage, regardless of whether the applied voltage is a permanently-applied AC mains voltage or digital control signals;

means for converting an amplitude of an applied AC voltage into pulse width information; and means for converting the pulse width information into control commands for a lamp operating device.

8. An interface circuit for a lamp operating device such as an electronic ballast for gas discharge lamps, said circuit including:

a digital control input and evaluation logic portion connected to process signals fed to terminals of the interface and to issue control commands;

a settable voltage divider connected with the digital control input and arranged to be supplied with main voltage, for setting the amplitude of a mains voltage applied to the digital control input; and Zener diodes arranged to subject the applied mains voltage to bipolar thresholding.

* * * * *